US007574971B2

(12) United States Patent
Butts et al.

(10) Patent No.: US 7,574,971 B2
(45) Date of Patent: Aug. 18, 2009

(54) TORPEDO MOUNTED DISPENSER INCORPORATING A SHOCK MOUNT BUMPER

(75) Inventors: James C. Butts, Casco, ME (US); Stephen F. Oliver, Portsmouth, RI (US); Donald L. Cox, West Kingston, RI (US); David A. Abdow, Somerset, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1901 days.

(21) Appl. No.: 09/874,465

(22) Filed: Jun. 4, 2001

(65) Prior Publication Data

US 2002/0178983 A1 Dec. 5, 2002

(51) Int. Cl.
*F41F 3/10* (2006.01)

(52) U.S. Cl. ..... 114/21.2; 114/238

(58) Field of Classification Search ..... 114/20.1, 114/21.1, 238; 244/3.12
See application file for complete search history.

(56) References Cited

U.S. PATENT DOCUMENTS 3,565,028 A * 2/1971 Hancks et al. ..... 114/20
3,703,874 A * 11/1972 Lemieux ..... 114/21 R
3,706,293 A * 12/1972 Hancks et al. ..... 114/20
4,349,292 A * 9/1982 Albert, Jr. ..... 403/322
4,819,503 A 4/1989 Fazi, Jr. et al. ..... 74/574
4,887,788 A 12/1989 Fischer et al. ..... 248/562
5,040,764 A 8/1991 Dubois ..... 248/635
5,158,030 A 10/1992 Dubois et al. ..... 114/20.1
5,385,109 A * 1/1995 Hrycin et al. ..... 114/238
5,396,855 A 3/1995 Dubois et al. ..... 114/20.1
5,637,825 A * 6/1997 Glenning ..... 114/21.1
6,242,684 B1 * 6/2001 Oliver et al. ..... 114/20.1

FOREIGN PATENT DOCUMENTS

EP 0504049 A1 * 12/1992 ..... 244/3.12
FR 2654204 A1 * 9/1989 ..... 244/3.12

* cited by examiner

*Primary Examiner*—Michael Carone
(74) *Attorney, Agent, or Firm*—James M. Kasischke; Michael P. Stanley; Jean-Paul A. Nasser

(57) ABSTRACT

A torpedo tail mounted dispenser (TMD) for deploying an elongated, flexible article generally along a deployment axis, which includes a receptacle for storing the article in a multiple-turn, multiple-layer configuration about the deployment axis in a storage volume. There is also a torpedo connector mechanism having a terminal forward face and a lateral peripheral surface extending away from the receptacle along the deployment axis. An elastomeric cushioning feature is mounted on the lateral peripheral surface of the connector mechanism. An annular elastomeric bumper is mounted on a forward peripheral face of the cushioning feature, the annular opening of the bumper surrounding the connector mechanism to allow connection of the TMD to a torpedo. The bumper provides protection to the TMD and torpedo under certain shock and vibration levels.

8 Claims, 5 Drawing Sheets

TORPEDO MOUNTED DISPENSER INCORPORATING A SHOCK MOUNT BUMPER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to marine vessels and more particularly to wire-guided torpedoes for use thereon.

(2) Brief Description of the Prior Art

The MK 48 Torpedo utilizes a torpedo Tail Mounted Dispenser (TMD) as an integral part of its guidance wire communication system. The function of the TMD is to house a guidance wire coil and allow for successful deployment of a hollow core flexible cable known as a flex-hose that is used to position the guidance wire that is paying out through it, below the submarine's keel and propeller. A prior art TMD is disclosed in U.S. Pat. No. 5,385,109, the contents of which are incorporated herein by reference.

The TMD is attached to the tail end of the torpedo prior to loading the torpedo onboard the submarine and is stowed along with the torpedo inside of the submarine's torpedo room. Torpedoes are presently secured on U.S. Naval submarine weapon stowage and handling system (WSHS) by means of four dollies equipped with lashing straps. The TMD is suspended off the tail end of the torpedo and is not secured by one of the dollies and lashing straps. It has been determined that certain shock and vibration levels can cause significant displacement of the TMD, which can damage the TMD and the torpedo.

The prior art discloses a number of devices for the wire guidance of torpedoes and for reducing shock and vibration.

U.S. Pat. No. 3,565,028 to Hancks et al., for example, discloses a torpedo, which can be launched conventionally from a torpedo tube and trails a hydrophone on a long cable. A shroud encircling the propellers is articulated on a ball and socket joint to steer the torpedo, and to serve as a reel for carrying the long cable until after launching. Holddown fingers, which keep the coiled cable in place, are scuttled a measured time after launch. There is, however no disclosure of any means for reducing shock and vibration.

U.S. Pat. No. 4,819,503 to Fazi, Jr. et al. discloses a low frequency structure borne vibration isolation mount including an annular disk pad of vibration damping material which is sandwiched and bonded between two similar light but rugged annular disks. The annular disk pad and the two annular disks have equal numbers of matching and corresponding holes along the circumferences thereof. The sizes of the holes are so chosen that one of the annular disks can be secured to the moving piece of equipment and isolated from everything else and the other annular disk can be secured to the stationary piece of equipment. The vibrations of the moving piece of equipment are thus isolated from everything else. There is, however, no teaching of any way of increasing survivability during or after shock events.

U.S. Pat. No. 4,887,788 to Fisher et al. discloses a device for absorbing the energy of vibration of one of two abutting members which has begun to vibrate due to forces applied to either of the two abutting members, so as to reduce the frequency and magnitude of vibration of one of the two abutting members. The primary energy absorbing element is a piece of elastomeric resilient material which contains a core (or cores) of a substantially incompressible, highly efficient dampening material; the presence or absence of this core of highly efficient dampening material will depend upon desired device stiffness and dampening characteristics. The primary energy-absorbing element is surrounded by a flexible reinforced shell, which contains and restrains said element, yet allows said element to deform in the transverse and vertical directions. Two end pieces or mounting plates are secured to opposite ends of the primary energy-absorbing element. This patent, however, does not disclose a method of protecting a structure against high impact shock events.

U.S. Pat. No. 5,040,764 to Dubois discloses a mounting assembly for absorbing low frequency vibrational energy as produced by a source and isolating a base member therefrom, the mounting assembly including a central metallic ring, non-metallic foam rings located on both sides of the central metallic ring in concentric relation with respect thereto, and inner and outer metallic ring members engaging said foam rings in concentric relation, the foam rings defining a spongy mass that effectively absorbs the low frequency vibrational energy emanating from the source. This patent does not disclose any shock benefits to the torpedo or the torpedo mounted dispenser. In addition, the design disclosed in this patent requires mounting to multiple structures.

U.S. Pat. No. 5,158,030 to DuBois et al. discloses a damped flexible seal assembly for a torpedo, which isolates the tailcone thereof from vibrational energy present in the drive shaft assembly. A pair of outside flanges, each of which include an inwardly facing groove and an O-ring constrained therein, provide a watertight seal against the outer non-rotating surface of the drive shaft assembly. An inside flange includes an outwardly facing groove and an O-ring constrained therein, and provides a watertight seal against the inner surface of the tail cone. Two cast-in-place elastomeric seals provide a watertight seal between the flanges and further provide a damping barrier between the outside flanges and the inside flanges for damping vibrational energy present in the drive shaft assembly before the energy can reach the tailcone through the seal assembly. This arrangement does not, however, provide any benefits toward enhancing the chances that a torpedo will survive a shock event.

U.S. Pat. No. 5,396,855 to DuBois discloses an underwater vehicle tailcone assembly including a forward flange, a first tubular sheath extending rearwardly from the forward flange, and elastomer material bonded to inner and outer surfaces of the first sheath to form a forward chamber wall. The assembly further includes an aft flange, a second tubular sheath extending forwardly from the aft flange, and elastomer material bonded to inner and outer surfaces of the second sheath to form an aft chamber wall. The assembly still further includes a rigid housing wall disposed between a rearward end of the forward chamber wall and a forward end of the aft chamber wall. The forward chamber wall forms a continuous tailcone wall from a forward edge of the forward flange to a rearward edge of the aft flange. This patent, however, also does not disclose any features for protecting the torpedo from damage during shock events.

SUMMARY OF THE INVENTION

It is an object of the present invention to provide a TMD, which incorporates means for protecting the TMD and the torpedo with which the TMD is used from shock and vibration events.

This object is accomplished by the present invention, which is a TMD for deploying an elongated, flexible article generally along a deployment axis. This TMD includes a receptacle means storing the article in a multiple-turn, multiple-layer configuration about the deployment axis in a storage volume. There is also a torpedo connector mechanism having a terminal forward face and a lateral peripheral surface extending away from the receptacle along the deployment axis. An elastomeric cushioning feature is mounted on the lateral peripheral surface of the connector mechanism. Another elastomeric cushioning feature is mounted on the terminal forward face of the connector mechanism.

Tail Mounted Dispensers (TMD's) are a major component of the MK 48 Torpedo wire payout communication systems. The communication system has two payout coils, one in the torpedo's fuel tank and one in the TMD. During stowage in the torpedo room, the TMD is attached to the tail end of the torpedo. The TMD contains a coiled, weighted, flexible, hollow hose, through which the wire passes. The TMD adds considerable weight to the tail of the torpedo. The interaction of the TMD on the torpedo during certain shock and vibration levels can damage the TMD and the torpedo. The introduction of an elastomeric bumper between the tail end of the torpedo and the TMD minimized the shock impact forces imparted on the torpedo and the TMD. The device consists of a cylindrical, hollow, elastomeric bumper that is secured to a shock mount and ball-locking assembly mounted on the forward portion of the TMD. The bumper fills the majority of a void between the TMD and the torpedo when the TMD is mounted onto the torpedo.

The bumper is bolted to the forward face of the TMD shock mount. The ball-locking ring assembly is also bolted to the forward face of the TMD shock mount assembly. During installation of the TMD onto the torpedo, the ball-locking ring is positioned over the bell mouth adapter on the torpedo. The ball-locking ring is locked into position on the torpedo's bell mouth adapter when the TMD locking mechanism is activated. The bell mouth adapter is attached to the exhaust valve, which in turn is attached to the torpedo drive shaft. During a shock event, the bumper contacts the torpedo's shroud, transferring some of the TMD's energy into the shroud and the bumper and away from the drive shaft. Incorporation of the elastomeric resilient bumper positioned between the TMD and the torpedo minimizes displacement of the TMD and absorbs energy created by displacement of the TMD, which in turn prevents damage to the TMD and the torpedo. It has been shown that the strains in the drive shaft are lowered during shock when the bumper is installed The lowered strains increase the shock survivability of the exhaust valve/drive shaft joint, the exhaust valve/bell mouth joint and the propulsion system. The bumper cushions the TMD locking mechanism and reduces the motion of the TMD. This feature keeps the TMD's locking mechanism from becoming disengaged and impacting the shroud assembly of the torpedo. This eliminates damage to the torpedo shroud and the TMD ball-locking mechanism.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts in the drawings and wherein.

DESCRIPTION OF THE PREFERRED EMBODIMENT

Figure 1:
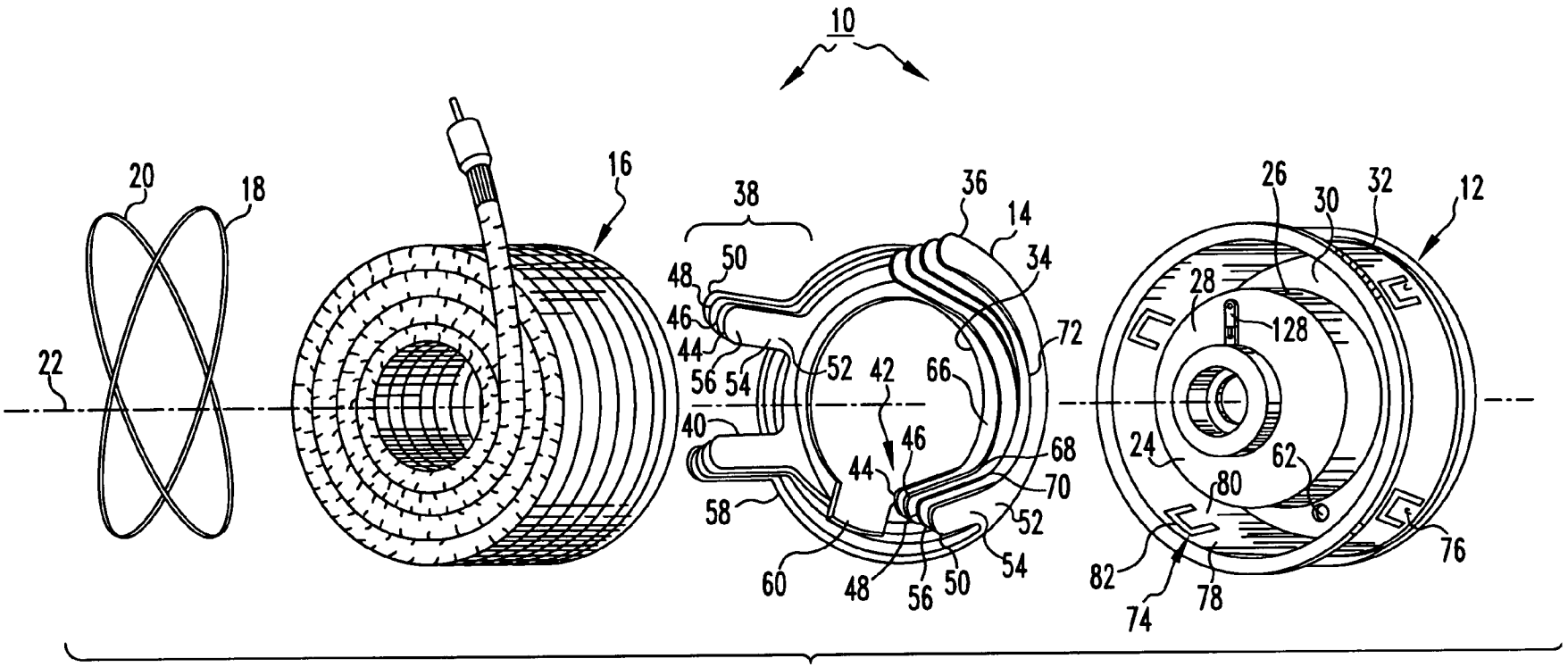
FIG. 1 is a fragmented perspective view of a preferred embodiment of the dispenser of the present invention without the connecting mechanism for attachment to a torpedo.
Figure 2:
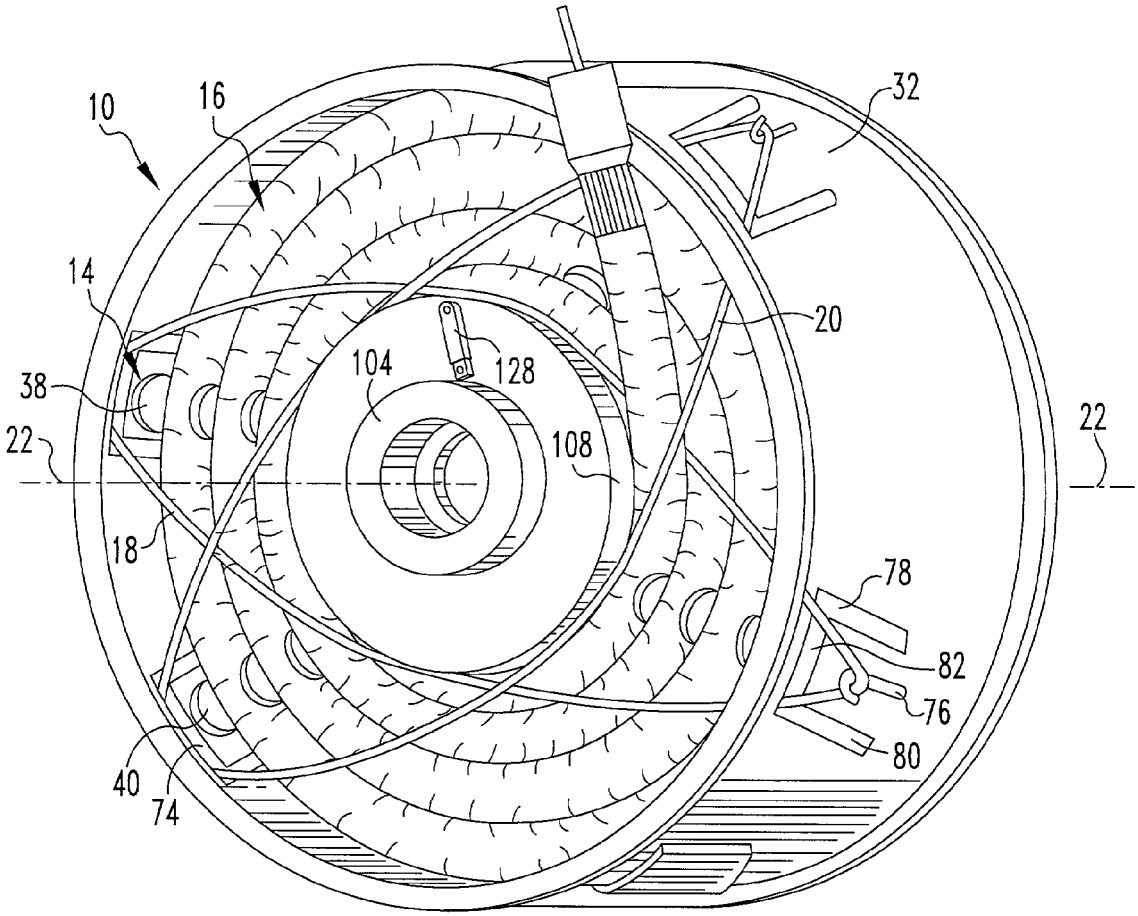
FIG. 2 is a perspective front view of the dispenser shown in FIG. 1.

Referring to FIGS. 1-2, a dispenser 10 includes receptacle 12, and a partitioning insert 14 for storing an elongated flexible hose 16 with an internal conductor or conductors as a multi-turn, multi-layer coil. The restraining bands 18 and 20 complete the dispenser 10. These components are mounted together coaxially about a deployment axis 22 that is generally horizontal in a submarine application. The receptacle 12 includes a cylindrical hub 24 that contains, within cylindrical wall 26 and an end wall 28, various mounting hardware for connection to a torpedo. Base plate 30 extends radially from one end of the hub 24 to support a cylindrical shell 32 that is concentric with and spaced from the cylindrical wall 26. The partitioning insert 14 is molded or cast with an annular base 34 that attaches or butts the base plate 30. The partitioning insert 14 also includes four finger sets 36, 38, 40 and 42, perpendicular to and extending from base 34 in a direction parallel to axis 22 and spaced approximately 90° about axis 22. Each of the finger sets includes a radial inner finger 44, intermediate fingers 46 and 48 and a radial outer finger 50. Each finger has, for example, a base portion 52, an intermediate portion 54, and a free end 56. An arcuate extension 58 is positioned between the base portion 52 and a base portion of an adjacent finger. There are no extensions between finger sets 40 and 42 as this area constitutes a transition area 60 in which the flexible hose 16 can transfer smoothly between adjacent channels.

Figure 3:
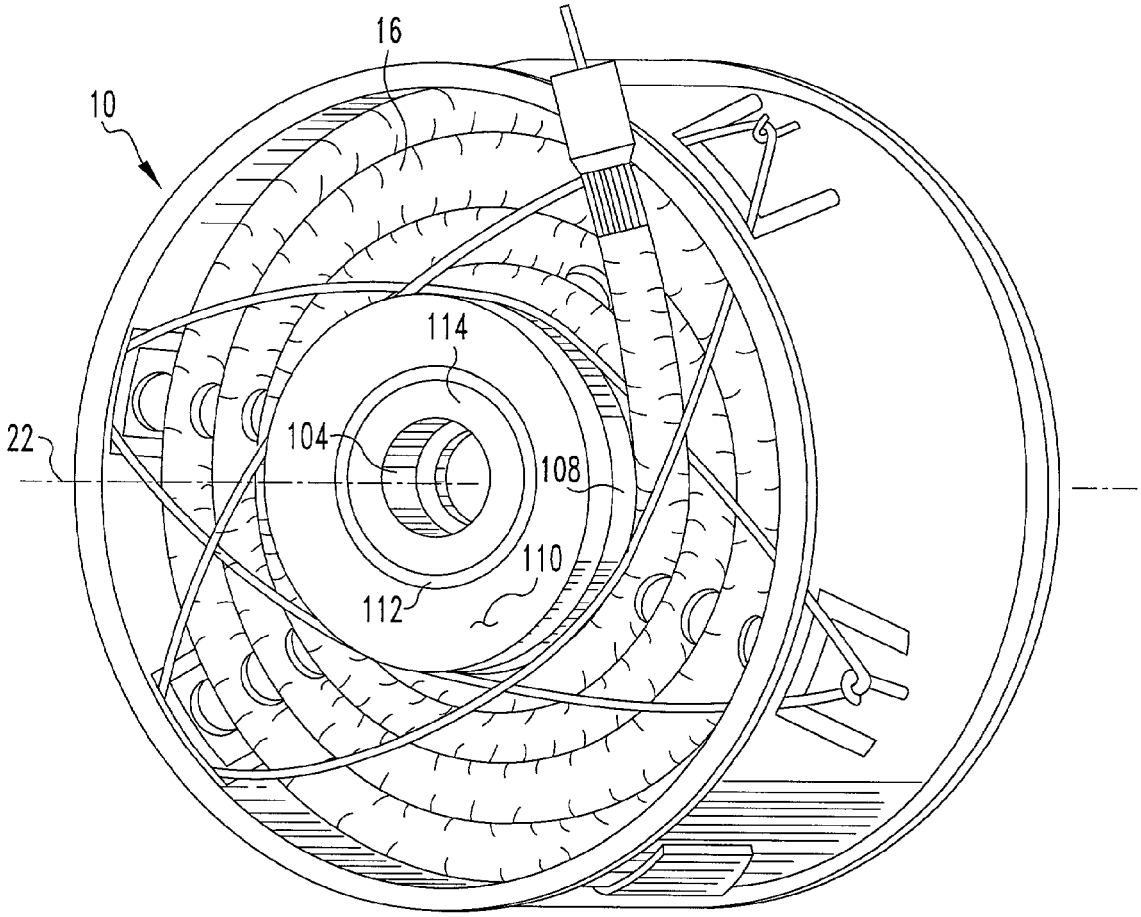
FIG. 3 is a front and side perspective view of the dispenser of FIG. 2 incorporating the bumper of the present invention.
Figure 4:
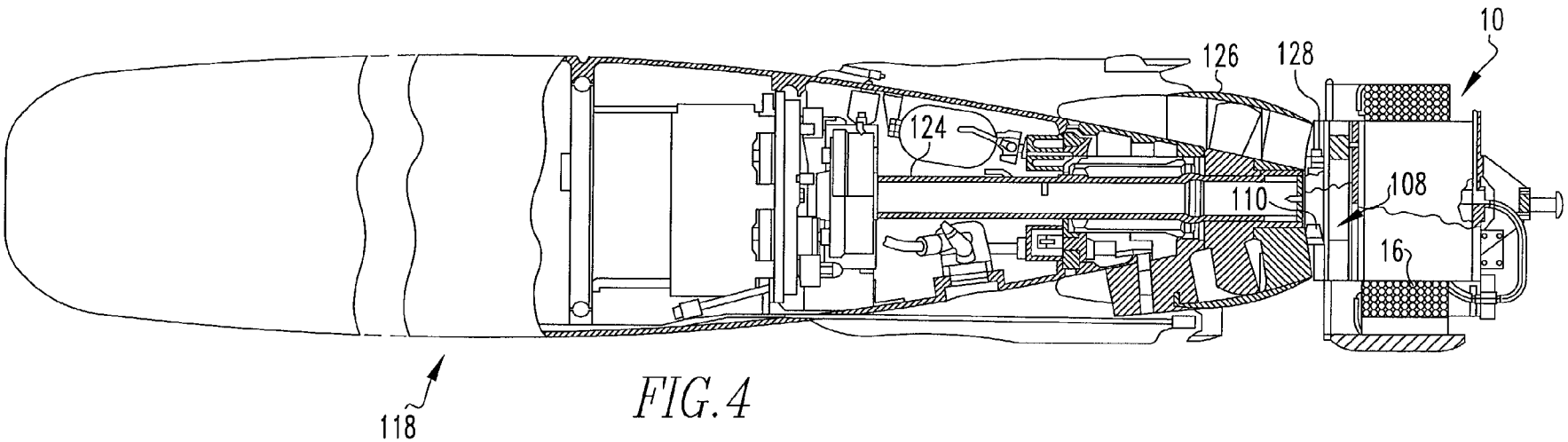
FIG. 4 is a cutaway side elevational view of a torpedo in which the TMD assembly shown in FIG. 3 is engaged.
Figure 5:
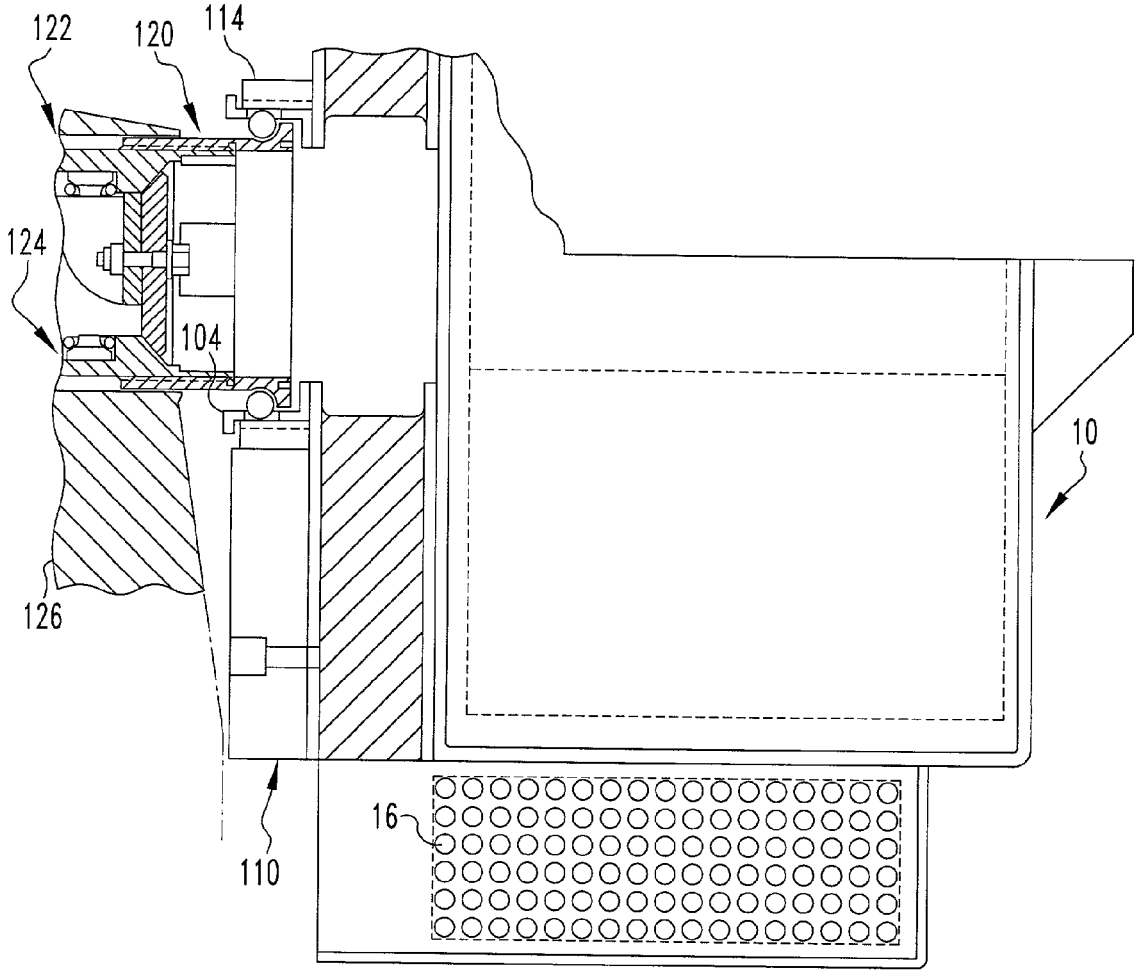
FIG. 5 is an enlarged view of a portion of FIG. 4.

The TMD 10 further includes a mechanical connector mechanism 104 secured to a shock mount 108 (not shown in FIG. 1) on its lateral peripheral surface. Elastomeric lateral peripheral shock mount 108 is attached to hub 24. Referring now also to FIGS. 3-5, TMD 10 includes annular, elastomeric bumper 110 secured to a forward peripheral surface of shock mount 108 and having a central aperture 112 to permit exposure of ball-locking ring assembly 114. TMD 10 is connected to a torpedo 118 at bell mouth adapter 120 of torpedo 118, which connects to the ball-locking ring assembly 114 and mechanical connector mechanism 104 of TMD 10. Adjacent the bell mouth adapter 120 there is an exhaust valve 122 and the bell mouth adapter 120 connects to drive shaft 124 of torpedo 118. Outwardly adjacent the drive shaft 124 there is a shroud 126 that is positioned in opposed relation to the terminal front shock mount bumper 110.

During certain shock and vibration levels, bumper 110 prevents the TMD locking mechanism from directly impacting shroud 126, so as to avoid the possibility of damage to shroud 126, which may render the locking/unlocking mechanism 104, 114 inoperable. The use of bumper 110 also avoids the possibility that torpedo 118 cannot be deployed because the TMD 10 cannot be unlocked and detached from torpedo 118. The elastomeric bumper 110 also minimizes displacement of TMD 10 and absorbs energy created by the displacement of TMD 10, thus reducing damaging loads imparted to the torpedo. Additionally, it will be understood that bumper 110 is an extremely simple and easily implemented modification to prior art TMD 10 that produces exceptional results. Further, bumper 110 covers the locking mechanism 128 (as shown in FIG. 4), inhibiting the locking mechanism 128 from impacting and damaging shroud 126 and preventing disengagement of locking mechanism 128 from locking ring assembly 114.

Those skilled in the art will appreciate that a wide range of materials, coatings, and molding and fabrication techniques may be used within the scope of this invention to maximize performance and minimize costs. Also, different values of the modulus and damping coefficients for the elastomer bumper may be employed with the scope of this invention to optimize the performance in conjunction with profiling the shape of the bumper. Furthermore, multiple layers of structures, elastomer, mass and damping materials may also be employed to provide fine-tuning for the bumper response without departing from the spirit of this invention.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A dispenser for deploying an elongated, flexible article generally along a deployment axis, said dispenser comprising:

a receptacle means for storing the article in a multiple-turn, multiple-layer configuration about the deployment axis in a storage volume;

a connector means having a terminal forward face and a lateral peripheral surface extending away from the receptacle along the deployment axis;

a first elastomeric cushioning means mounted on the lateral peripheral surface of the connector means; and an annular elastomeric cushioning means mounted on a forward face of the first elastomeric cushioning means, a central aperture of the annular elastomeric cushioning means surrounding the terminal forward face of the connector means.

2. The dispenser of claim 1 wherein the annular elastomeric cushioning means is a shock mount bumper.

3. The dispenser of claim 2 wherein the connector means is cylindrical.

4. The dispenser of claim 3 wherein there is a locking ring on the terminal forward face of the connector means and the central aperture in the shock mount bumper exposes said locking ring.

5. The dispenser of claim 1 wherein there is a locking mechanism for securing the connector means to a torpedo, the annular elastomeric cushioning means preventing disengagement of the locking mechanism.

6. The dispenser of claim 4 wherein there is a locking mechanism on the forward face of the first elastomeric cushioning means, the shock mount bumper covering the locking mechanism to prevent disengagement of the locking mechanism from the locking ring.

7. An assembly comprising:

a torpedo having a bell mouth adapter with a peripheral shroud at an aft end of the torpedo;

a receptacle for storing an elongated article in a multiple-turn, multiple-layer configuration about a deployment axis in a storage volume;

a generally cylindrical connector extending from the receptacle and having a terminal front face and a lateral peripheral surface, there being a ball-locking ring assembly on said terminal front face and said ball-locking ring assembly is engaged with the bell mouth adapter of the torpedo;

a first elastomeric cushioning means mounted on the lateral peripheral surface of the connector; and a second elastomeric cushioning means mounted on a front face of the first elastomeric cushioning means in outer axial relation to the ball-locking ring assembly and in opposed relation to the shroud on the torpedo.

8. The assembly of claim 7 wherein the second elastomeric cushioning means is a shock mount bumper.

* * * * *